US010018381B2

(12) United States Patent
Xu

(10) Patent No.: US 10,018,381 B2
(45) Date of Patent: Jul. 10, 2018

(54) CRYOGENIC REFRIGERATOR

(71) Applicant: SUMITOMO HEAVY INDUSTRIES, LTD., Tokyo (JP)

(72) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 410 days.

(21) Appl. No.: 14/183,806

(22) Filed: Feb. 19, 2014

(65) Prior Publication Data

US 2014/0238047 A1 Aug. 28, 2014

(30) Foreign Application Priority Data

Feb. 26, 2013 (JP) ..... 2013-036297

(51) Int. Cl.
*F25B 9/14* (2006.01)
*F25B 9/10* (2006.01)

(52) U.S. Cl.
CPC ..... *F25B 9/145* (2013.01); *F25B 9/10* (2013.01); *F25B 2309/1411* (2013.01); *F25B 2309/1413* (2013.01); *F25B 2309/1418* (2013.01); *F25B 2309/1426* (2013.01)

(58) Field of Classification Search
CPC ..... F25B 9/14; F25B 9/145
See application file for complete search history.

(56) References Cited

U.S. PATENT DOCUMENTS 5,974,807 A * 11/1999 Gao ..... F25B 9/145 165/4
6,629,418 B1 * 10/2003 Gao ..... F25B 9/145 60/520
7,081,609 B2 7/2006 Matsumoto
2005/0022539 A1 * 2/2005 Price ..... F25B 9/10 62/6
2006/0144054 A1 * 7/2006 Xu ..... F25B 9/10 62/6

FOREIGN PATENT DOCUMENTS

JP 2006-234338 9/2006
JP 4147997 9/2008
JP WO 2011158281 A1 * 12/2011 ..... F25B 9/14

* cited by examiner

*Primary Examiner* — Elizabeth Martin
*Assistant Examiner* — Zachary R Anderegg
(74) *Attorney, Agent, or Firm* — IPUSA, PLLC

(57) ABSTRACT

A disclosed cryogenic refrigerator includes a first refrigerator including a compressor, a regenerator which performs intake or ejection of a refrigerant gas relative to the compressor, and a pulse tube whose low temperature end is connected to a low temperature end of the regenerator; a second refrigerator having an output smaller than the first refrigerator; a connecting pipe which performs intake and ejection of the refrigerant gas relative to a high temperature end of the pulse tube and the second refrigerator; and a flow control valve which is provided in the connecting pipe and performs a flow control of the refrigerant gas flowing inside the connecting pipe.

5 Claims, 3 Drawing Sheets

CRYOGENIC REFRIGERATOR

RELATED APPLICATIONS

Priority is claimed to Japanese Patent Application No. 2013-036297 filed on Feb. 26, 2013, the entire contents of which are incorporated herein by reference.

BACKGROUND

1. Technical Field

The present invention relates to a cryogenic refrigerator.

2. Description of the Related Art

An example of a refrigerator which can produce an ultralow temperature with small vibration is a pulse tube refrigerator. This pulse tube refrigerator includes a compressor, a regenerator, a pulse tube connected to the regenerator, a buffer orifice, a buffer tank and so on, which are connected to the pulse tube. A refrigerant gas (e.g., a helium gas) is taken and ejected by the regenerator and the pulse tube at a predetermined timing.

Further, the buffer tank connected to the pulse tube functions as a phase control mechanism where a phase difference between the pressure variation of the refrigerant gas and a displacement are controlled. Therefore, cooling is produced on a low temperature side of the pulse tube by appropriately controlling the phase difference between the pressure variation of the refrigerant gas and a displacement.

Further, in a cryogenic refrigerator, a refrigeration efficiency may be improved by directly connecting first and second pulse tube portions including a pulse tube and a regenerator, respectively.

SUMMARY

One aspect of the embodiments of the present invention may be to provide a cryogenic refrigerator including a first refrigerator including a compressor, a regenerator which performs intake or ejection of a refrigerant gas relative to the compressor, and a pulse tube whose low temperature end is connected to a low temperature end of the regenerator; a second refrigerator having an output smaller than the first refrigerator; a connecting pipe which performs intake and ejection of the refrigerant gas relative to a high temperature end of the pulse tube and the second refrigerator; and a flow control valve which is provided in the connecting pipe and performs a flow control of the refrigerant gas flowing inside the connecting pipe.

DETAILED DESCRIPTION

In the above cryogenic refrigerator, in a case where a gas piston for the refrigerant gas is assumed to exist inside the pulse tube included in the first pulse tube portion, a phase control of the gas piston cannot be properly performed. Therefore, the amount of displacement of the gas piston relative to the pulse tube may possibly become too great. In this case, the displacement of the gas piston exceeds the pulse tube, and the refrigeration efficiency may not be sufficiently improved.

The objects of the present invention are to provide a cryogenic refrigerator where refrigeration efficiency is improved by effectively using energy generated at a time of performing a refrigeration process.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

First Embodiment

A description is given below, with reference to the FIG. 1 through FIG. 3 of embodiments of the present invention. Where the same reference symbols are attached to the same parts, repeated description of the parts is omitted.

Figure 1:
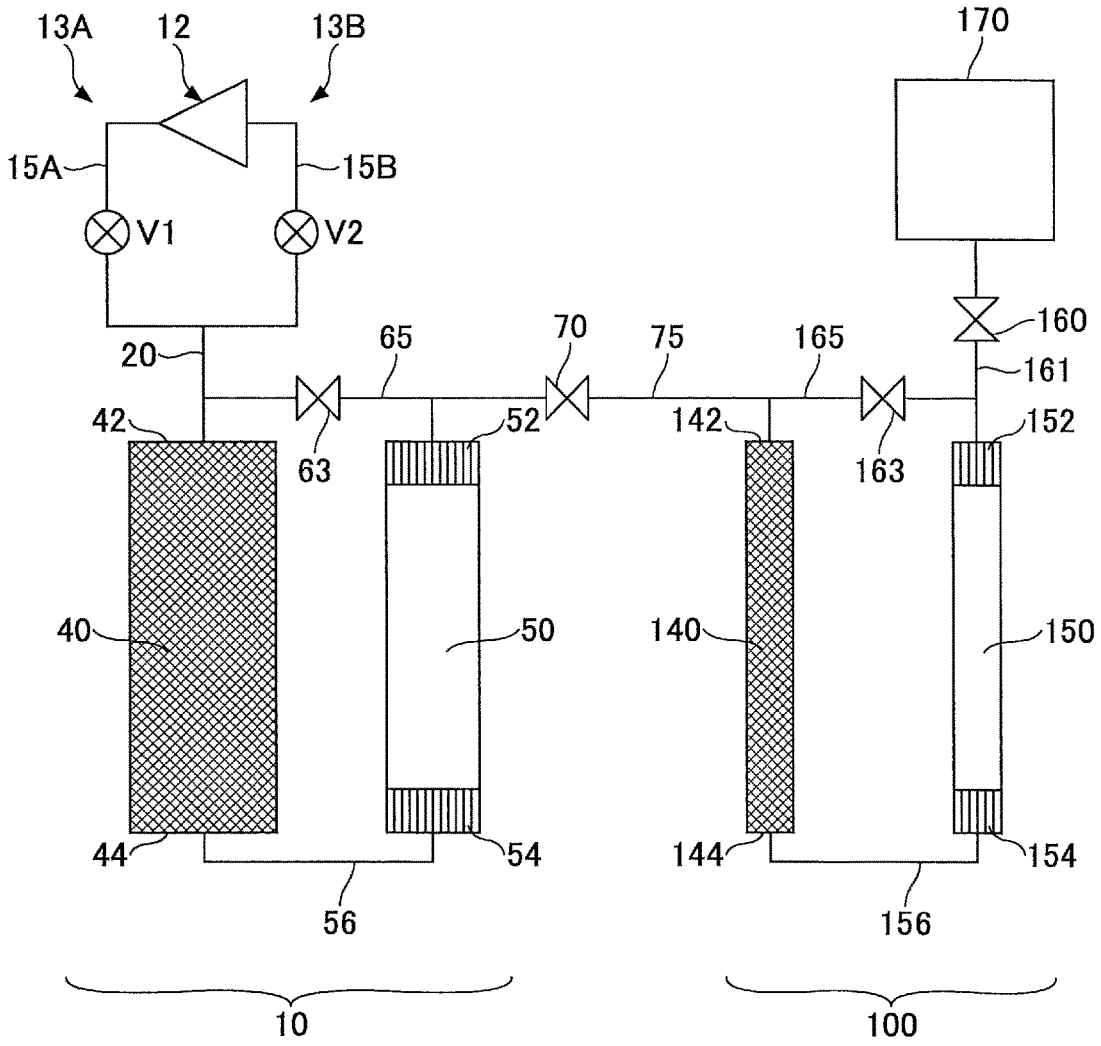
FIG. 1 illustrates a structure of a cryogenic refrigerator in an embodiment of the present invention.

FIG. 1 schematically illustrates a structure of a cryogenic refrigerator in a first embodiment of the present invention. The cryogenic refrigerator of the embodiment includes a first refrigerator 10, a second refrigerator 100, a connecting pipe 75, and so on.

At first, the first refrigerator 10 is described. The first refrigerator 10 forms a double inlet type refrigerator of a single stage type. However, an orifice and a buffer tank are not provided to the first refrigerator 10.

This first refrigerator 10 includes a compressor 12, a regenerator 40, a pulse tube 50, and so on.

The compressor 12 includes a high pressure (supply side) refrigerant flow path 13A and a low pressure (suction side) refrigerant flow path 13B. The high pressure refrigerant flow path 13A includes a high pressure pipe 15A and a high pressure on-off valve V1 provided in the high pressure pipe 15A. The low pressure refrigerant flow path 13B includes a low pressure pipe 15B and a low pressure on-off valve V2 provided in the low pressure pipe 15B.

An end portion of the high pressure pipe 15A is connected to a supply side of the compressor 12, and the other end of the high pressure pipe 15A is connected to an end portion of the common pipe 20. An end of the low pressure pipe 15B is connected to a suction side of the compressor 12, and the other end of the low pressure pipe 15B is connected to the end of the common pipe 20. The other end of the common pipe 20 is connected to a high temperature end 42 of the regenerator 40.

Therefore, when the high pressure on-off valve V1 opens at a predetermined timing, a high pressure refrigerant gas (e.g., a helium gas) is supplied from the compressor 12 to the high pressure pipe 15A. When the high pressure on-off valve V1 opens at a predetermined timing, a low pressure refrigerant gas flows back from the low pressure pipe 15B to the compressor 12.

A regenerator material is filled inside the regenerator 40. The regenerator material may be a metallic mesh made of phosphor bronze, stainless steel, or the like having a high specific heat or a sphere made of lead, bismuth, a magnetic regenerator material, or the like.

The low temperature end 44 of the regenerator 40 is connected to a low temperature side of the pulse tube 50 through the connecting tube 56. The low temperature side heat exchanger 54 is provided on a low temperature side of the pulse tube 50, and the high temperature side heat exchanger 52 is provided on a high temperature side of the pulse tube 50. The above described connecting tube 56 is connected to the heat exchanger 54 provided on the low temperature side of the pulse tube 50.

Further, as described above, in the first refrigerator 10, the high temperature side of the pulse tube 50 is connected to the high temperature end of the regenerator 40 by the bypass pipe 65. A refrigerator having this type of the bypass pipe 65 may be called a "double inlet type pulse tube refrigerator". Specifically, an end of the bypass pipe 65 is connected to the common pipe 20, and the other end of the bypass pipe 65 is connected to the high temperature side heat exchanger 52.

Further, as described above, because the first refrigerator 10 forms the double inlet type pulse tube refrigerator, the high temperature side of the pulse tube 50 is connected to the high temperature end of the regenerator 40 by the bypass pipe 65. Specifically, one end portion of the bypass pipe 65 is connected to the common pipe 20, and the other end portion is connected to the high temperature side heat exchanger 52 of the pulse tube 50.

Further, a double inlet valve 63 is provided in the middle of the bypass pipe 65. By adjusting the double inlet valve 63, a phase control of the refrigerant gas in the pulse tube 50 described below can be accurately performed to thereby improve refrigeration properties.

Next, the second refrigerator 100 is described. Within the embodiment, the second refrigerator 100 is also a double inlet type pulse tube refrigerator of a single stage type.

The second refrigerator 100 includes a regenerator 140, a pulse tube 150, an orifice 160, a buffer tank 170, or the like.

In a manner similar to the regenerator 40 of the first refrigerator 10, the inside of the regenerator 140 is filled with a regenerator material such as a metallic mesh made of phosphor bronze, stainless steel, or the like or a regenerator material such as lead, bismuth, a magnetic regenerator material, or the like. The low temperature end 144 of the regenerator 140 is connected to the low temperature side of the pulse tube 150 through the connecting tube 156.

A low temperature side heat exchanger 154 is provided at the low temperature side of the pulse tube 150, and a high temperature side heat exchanger 152 is provided at the high temperature side of the pulse tube 150. The above connecting tube 156 is connected to the low temperature side heat exchanger 154 of the pulse tube 150.

Further, because the second refrigerator 100 is a double inlet type pulse tube refrigerator, the high temperature side of the pulse tube 150 (the heat exchanger 152) is connected to a high temperature end 142 of the regenerator 140 by a bypass pipe 165.

A double inlet valve 163 is provided in the middle of the bypass pipe 165. By adjusting the double inlet valve 163, it is possible to accurately perform the phase control of the refrigerant gas inside the pulse tube 150 described below to thereby improve the refrigeration properties.

Further, a buffer tank 170 is connected to the high temperature side of the pulse tube 150 through the buffer pipe 161. Further, a buffer orifice 160 (hereinafter, referred to as an orifice) is provided in the buffer pipe 161.

The orifice 161 and the buffer tank 170 function as a phase control mechanism for controlling the phase difference between the pressure variation and the displacement of the refrigerant gas inside the pulse tube 150 of the second refrigerator 100. By controlling the phase difference between the pressure variation and the phase difference of the refrigerant gas appropriately, cooling is produced on the low temperature side of the pulse tube.

The first refrigerator 10 and the second refrigerator 100 having the above structure are connected by a connecting pipe 75. Specifically, one end portion of the connecting pipe 75 is connected to the bypass pipe 65 connected to the high temperature side of the pulse tube 50 of the first refrigerator 10. The other end portion of the connecting pipe 75 is connected to the bypass pipe 165 connected to the high temperature side of the regenerator 140. Further, a flow control valve 70 is provided at a middle position of the connecting pipe 75.

Therefore, when the high pressure on-off valve V1 and the low pressure on-off valve V2 are alternately opened or closed at predetermined timings and oscillation is generated inside the pulse tube 50, the oscillation of the refrigerant gas is supplied to the second refrigerator 100 through the flow control valve 70 and the connecting pipe 75. With this, pressure variation of the refrigerant gas occurs inside the pulse tube 150. Further, the displacement of the refrigerant gas is controlled by the orifice 160. Accordingly, cooling is produced on the low temperature side of the pulse tube 150.

On the other hand, because the second refrigerator 100 having the above structure has a predetermined volume, it is possible to use the second refrigerator 100 as the buffer tank of the first refrigerator 10. Therefore, the flow control valve 70 and the second refrigerator 100 can function as a phase control mechanism 100 which can control a phase difference between the pressure variation and the phase difference of the refrigerant gas inside the pulse tube 50 of the first refrigerator 10.

With this, when the pressure variation of the refrigerant gas is produced in the pulse tube 50 and the displacement of the refrigerant gas is controlled by the flow control valve 70, cooling is produced on the low temperature side of the pulse tube 50.

As described, the cryogenic refrigerator of the first embodiment can produce cooling in both of the first refrigerator 10 and the second refrigerator 100. Therefore, it is possible to reduce energy consumed in the buffer tank in comparison with the conventional technique. Therefore, refrigeration efficiency can be enhanced by the cryogenic refrigerator of the embodiment.

Further, within the first embodiment, the flow control valve 70 is provided in the connecting pipe 75 which connects the first refrigerator 10 to the second refrigerator 100. Therefore, it is possible to control the phase difference between the pressure variation and the displacement inside the pulse tube 50 by the flow control valve 70 so as to be optimum or to be in a state close to the optimum.

Thus, cooling can be produced with high efficiency on the low temperature side of the pulse tube 50, and cooling can be produced by the first refrigerator 10 even if it is structured to connect the first refrigerator 10 to the second refrigerator 100. Therefore, the refrigeration efficiency of the first refrigerator 10 can be improved.

Within the cryogenic refrigerator of the first embodiment, the second refrigerator 100 is supplied with the refrigerant gas having oscillation produced by the first refrigerator 10, and performs a refrigeration process based on this refrigerant gas. Therefore, it is necessary to set the output of the second refrigerator 100 to be smaller than the output of the first refrigerator.

Specifically, it is desirable to make a relationship between flow rates F1 and F2 be F2≤(F1/5), where the flow rate of the refrigerant gas flowing from the compressor 12 into the regenerator 40 of the first refrigerator 10 is F1, and the flow rate of the refrigerant gas flowing from the first refrigerator 10 into the regenerator 140 of the second refrigerator 200 is F2.

Next, a modified example of the first embodiment is described.

Figure 2:
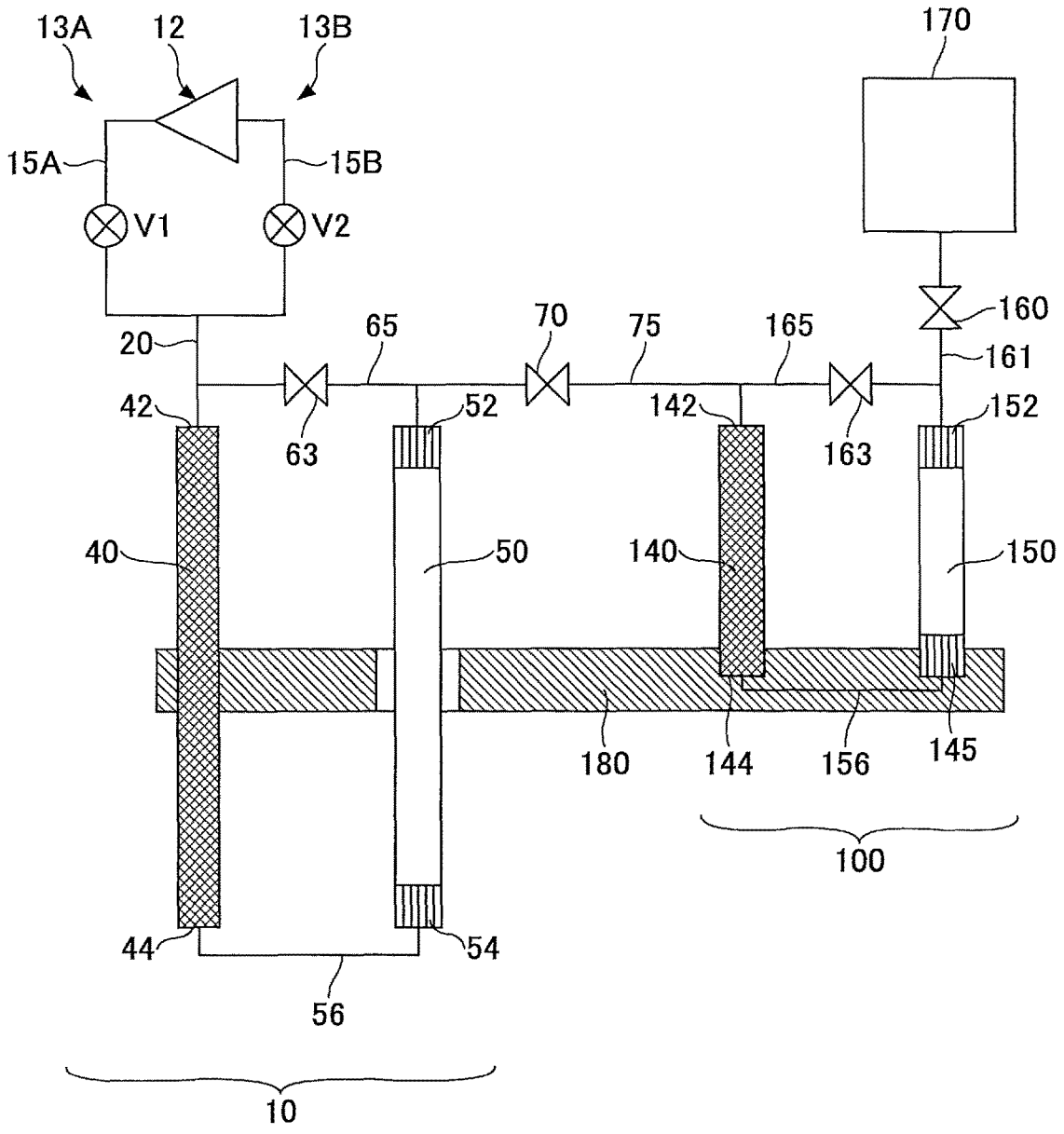
FIG. 2 illustrates a structure of another cryogenic refrigerator in a modified example of the embodiment of the present invention.

FIG. 2 schematically illustrates a structure of a cryogenic refrigerator in the modified example of the first embodiment. The same reference symbols are attached to components on the structure illustrated in FIG. 1, and description of the components is omitted.

Within the modified example, the low temperature side of the pulse tube 150 forming the second refrigerator 100 and the regenerator 40 forming the first refrigerator 100 are thermally connected by a heat transferring member 180.

The heat transferring member 180 is made of a metal such as copper having a high heat conductivity. The heat transferring member 180 is thermally connected to the low temperature end of the pulse tube 150 where cooling is produced in the second refrigerator 100. Further, the transferring member 180 is thermally connected to the low temperature end of the regenerator 140 and a substantially central position of the regenerator 40 which is positioned a predetermined distance apart from the low temperature end.

Therefore, it is possible to cool the low temperature side of the regenerator 140 and the position which is the predetermined distance apart from the low temperature end of the regenerator 140 by the cooling produced at the low temperature end of the pulse tube 150. Therefore, the regenerator material provided inside the regenerators 40 and 140 can be previously cooled to thereby enhance refrigeration efficiency of the cryogenic refrigerator.

Meanwhile, refrigeration capabilities of the first refrigerator 10 are higher than those of the second refrigerator 100, and therefore cooling having a lower temperature than the temperature of the pulse tube 150 is produced in the pulse tube 50. Therefore, the heat transferring member 180 is not thermally connected to the pulse tube 50.

Further, the refrigeration gas cooled to have an ultralow temperature by the cooling produced on the low temperature side of the pulse tube 50 flows into the low temperature end 44 of the regenerator 40. Therefore, the regenerator material provided at a position close to the low temperature end of the regenerator 40 is cooled by this refrigerant gas having the low temperature.

Therefore, within the modified example, the regenerator material inside the regenerator is efficiently cooled by connecting the heat transferring member 180 at a position a certain degree apart from the low temperature end 44 onto the high temperature end, specifically at a position where the temperature is higher than that of the heat transferring member 180.

Second Embodiment

Next, another embodiment of the present invention is described.

Figure 3:
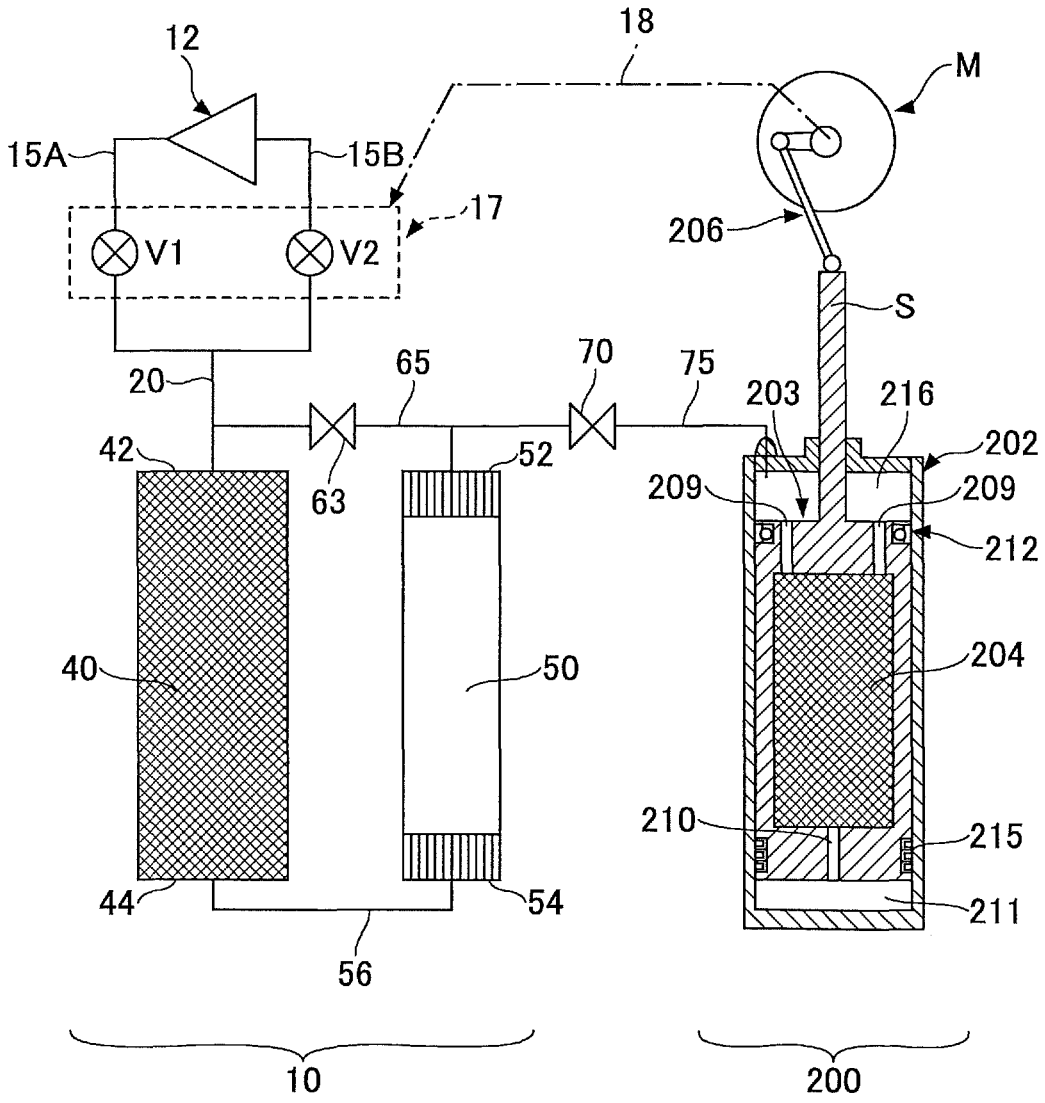
FIG. 3 illustrates a structure of another cryogenic refrigerator in another embodiment of the present invention.

FIG. 3 schematically illustrates a structure of another cryogenic refrigerator in second embodiment of the present invention. In FIG. 3, the same reference symbols are attached to components on the structure illustrated in FIG. 1, and description of the components is omitted.

Referring to FIG. 1 illustrating the cryogenic refrigerator of first embodiment, the second refrigerator 100 connected to the first refrigerator 10 is the pulse tube refrigerator. Within the second embodiment, a Gifford-McMahon refrigerator (hereinafter, a GM refrigerator) is used as the second refrigerator 200.

In the cryogenic refrigerator 10 illustrated in FIG. 3, the first refrigerator 10 is substantially the same as that of the first embodiment. However, the high pressure on-off valve V1 and the low pressure on-off valve V2 are a rotary valve 17 which is driven by a driving device 206 described later.

Within the second embodiment, a GM refrigerator of a single stage type is used as the second refrigerator 200. The output of the second refrigerator 200 formed as the GM refrigerator is set smaller than the output of the first refrigerator 10. Within the second embodiment, although the GM refrigerator of a single stage type is use as an example, a GM refrigerator of a multi stage type may be used as the second refrigerator 200.

The second refrigerator 200 includes a cylinder 202, a displacer 203, a regenerator material 204, a driving device 206, and so on. The displacer 203 is provided inside the cylinder 202. The displacer 203 is connected to the driving device 206 through a shaft S. Further, the regenerator material 204 is provided inside the displacer 203.

The driving device 206 includes a motor M and a scotch yoke mechanism (omitted in FIG. 3). The scotch yoke mechanism is driven by the motor M as a driving source and converts the rotational force of the motor M to a reciprocating force of the shaft S. When the motor M drives the driving device 206, the displacer 203 reciprocally moves in up and down directions inside the cylinder 202 in FIG. 3. Referring to FIG. 3, gas flow ports 209 are formed on an upper portion of the displacer 203, and a gas flow port 210 is formed on a lower portion of the displacer 203.

An expansion chamber 211 is formed between the lower end of the displacer 203 and the bottom surface of the cylinder 202. A room temperature chamber 216 is formed between the upper end of the displacer 203 and the upper surface of the cylinder 202.

The connecting pipe 75, whose one end is connected to the first refrigerator 10, is connected to the room chamber 216 at the other end of the connecting pipe 75. Therefore, the refrigerant gas inside the pulse tube 50 of the first refrigerator 10 is taken into or ejected from the room temperature chamber 216 through the connection pipe 75 along with the pressure variation.

The refrigerant gas supplied into the room temperature chamber 216 passes through the gas flow ports 209 and 210 and is supplied to the expansion chamber 211. Further, in order to prevent the refrigerant gas form flowing through a gap between an inner peripheral surface of the cylinder 202 and an outer peripheral surface of the displacer 203, sealing members 212 and 215 are provided between the cylinder 202 and the displacer 203.

The above-described driving device 206 is connected to the rotary valve 17 through the link mechanism 18. The displacer 203 and the rotary valve 17 (the high pressure on-off valve V1 and the low pressure on-off valve V2) are driven in synchronism with each other by the motor M.

Within the second embodiment, when the displacer 203 is positioned at the lower dead end, the high pressure on-off valve V1 of the rotary valve 17 is opened, and the high pressure refrigerant gas is supplied into the inside of the room temperature chamber 216 through the regenerator 40, the pulse tube 50, the connecting pipe 75, or the like. With this, the pressure inside the cylinder 202 increases.

Within the second embodiment, a relationship between flow rates F1 and F2 is $F2 \leq (F1/5)$, where the flow rate of the refrigerant gas flowing from the compressor 12 into the regenerator 40 of the first refrigerator 10 is F1, and the flow rate of the refrigerant gas flowing from the first refrigerator 10 to the room temperature chamber 216 of the second refrigerator 200 is F2.

Then, the motor M is driven to make the displacer 203 move upward to the upper dead end. With this, the high pressure refrigerant gas flows into the expansion chamber 211 after passing through the gas flow ports 209, the regenerator material 204, and the gas flow port 210.

Subsequently, the rotary valve 17 is activated to close the intake valve V1 and simultaneously to open the ejection valve V2 in synchronism with the motion of the displacer 203. With this the refrigerant gas inside the expansion chamber 211 expands and cooling is produced in the expansion chamber 211.

Subsequently, the motor M is driven to move the displacer 203 at the lower dead end again. With this, the expanded refrigerant gas passes through the gas flow port 210, the regenerator material 204, the gas port 209, the room temperature chamber 216, the connecting pipe 75, the pulse tube 50, the regenerator 40, or the like and is recovered by the compressor 12. By repeating the above cycles, cooling is continuously produced by the second refrigerator 200.

In the cryogenic refrigerator of the second embodiment, cooling can be produced in any one of the first refrigerator 10 and the second refrigerator 200 and useless energy consumption can be reduced. Thus, the refrigeration efficiency can be enhanced. Further, within the embodiment, since a flow control valve 70 is provided in the connecting pipe 75, which connects the first refrigerator 10 to the second refrigerator 100, it is possible to enhance the refrigeration efficiency of the first refrigerator 10 by the flow control valve 70.

Further, since the single driving device 206 is used to drive the displacer 203 of the GM refrigerator being the second refrigerator 200 and to drive the rotary valve 17, the structure of the cryogenic refrigerator can be simplified, and the operation of the rotary valve 17 and the operation of the displacer 203 can be easily synchronized.

Although the double inlet type pulse tube refrigerator is used as the first and second refrigerator 10 and 100 in the above embodiments, the type of the pulse tube refrigerators may be another such as a basic type, an orifice type, and a four valve type.

Further, in the above embodiments, the pulse tube refrigerator or the GM refrigerator is used as the second refrigerator. However, other refrigerators having other structures such as a Solvay refrigerator or a Stirling refrigerator may be used.

According to the disclosed invention, oscillation of the refrigerant gas generated in the first refrigerator is used to produce cooling in the second refrigerator. Further, because a phase control of the first refrigerator can be properly performed by the flow control valve provided between the first refrigerator and the second refrigerator, refrigeration efficiency can be enhanced.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the cryogenic refrigerator has been described in detail, it should be understood that various changes, substitutions, and alterations could be made thereto without departing from the spirit and scope of the invention.

What is claimed is:

1. A cryogenic refrigerator comprising:

a first refrigerator including a compressor, a first regenerator which performs intake or ejection of a refrigerant gas relative to the compressor, and a first pulse tube whose low temperature end is connected to a low temperature end of the first regenerator, a second refrigerator including a second regenerator, the second refrigerator having an output smaller than an output from the first refrigerator, a connecting pipe connected between a high temperature end of the first pulse tube and a high temperature end of the second regenerator, the connecting pipe performing intake and ejection of the refrigerant gas between the high temperature end of the first pulse tube and the high temperature end of the second regenerator, the refrigerant gas being supplied from the compressor to the second regenerator and sucked by the compressor from the second regenerator only through the connecting pipe; and a flow control valve which is provided in the connecting pipe and performs a flow control of the refrigerant gas flowing inside the connecting pipe.

2. The cryogenic refrigerator according to claim 1, wherein the second refrigerator further includes a second pulse tube whose low temperature end is connected to a low temperature end of the second regenerator, wherein a high temperature of the second pulse tube is connected to the high temperature end of the second regenerator.

3. The cryogenic refrigerator according to claim 1, wherein the second refrigerator is a GM refrigerator.

4. The cryogenic refrigerator according to claim 3, further comprising:

a valve for performing an intake and ejection process of the refrigerant gas between the compressor and the first regenerator, wherein a driving mechanism for driving the GM refrigerator and the valve are driven by a single driving device.

5. The cryogenic refrigerator according to claim 1, wherein the output is a cooling capacity.

* * * * *